US011950714B2

(12) United States Patent
Johnson

(10) Patent No.: US 11,950,714 B2
(45) Date of Patent: Apr. 9, 2024

(54) WIG WASHING AND DRYING DEVICE

(71) Applicant: Cynthia Johnson, Brookville, OH (US)

(72) Inventor: Cynthia Johnson, Brookville, OH (US)

( * ) Notice: Subject to any disclaimer, the term of this patent is extended or adjusted under 35 U.S.C. 154(b) by 0 days.

(21) Appl. No.: 18/329,796

(22) Filed: Jun. 6, 2023

(65) Prior Publication Data

US 2023/0309719 A1 Oct. 5, 2023

Related U.S. Application Data

(63) Continuation of application No. 17/746,026, filed on May 17, 2022, now Pat. No. 11,707,145.

(60) Provisional application No. 63/335,264, filed on Apr. 27, 2022, provisional application No. 63/193,642, filed on May 27, 2021.

(51) Int. Cl.
*A47F 7/06* (2006.01)
*A47K 3/28* (2006.01)

(52) U.S. Cl.
CPC ..... *A47F 7/065* (2013.01); *A47K 3/281* (2013.01)

(58) Field of Classification Search
CPC ..... A47F 7/06; A47F 7/065; A47K 3/281; A45D 44/04
See application file for complete search history.

(56) References Cited

U.S. PATENT DOCUMENTS 503,949 A * 8/1893 Crouch ..... A47G 25/10 211/32
1,171,198 A * 2/1916 Hellberg ..... E04F 10/0614 211/32
1,698,633 A * 1/1929 Jimenez ..... A47G 25/10 33/8
1,746,487 A * 2/1930 Martin ..... A47G 25/10 33/8
2,416,464 A * 2/1947 Amen ..... A47G 25/10 211/100
3,198,408 A * 8/1965 Benner ..... A47F 7/065 446/268
3,300,108 A * 1/1967 Schumer ..... A45D 44/14 248/176.1
3,464,603 A * 9/1969 Hunter ..... A45D 44/14 223/66
3,465,926 A * 9/1969 Schwartz ..... A45D 44/14 248/176.1
3,515,318 A * 6/1970 Preble ..... A45D 44/14 223/66

(Continued)

*Primary Examiner* — Stanton L Krycinski

(74) *Attorney, Agent, or Firm* — Argus Intellectual Enterprise, LLC; Jordan Sworen; Daniel Enea

(57) ABSTRACT

A device for washing and drying a wig is provided. The wig washing and drying device includes a wig pod having a front facing dome member extending from a base. The dome member includes a generally curved front facing portion and an opposing flat side that is rear facing, wherein an arm extends from the flat side and connects with the base at a central region of the base. A bracket housing extends from a rear side of the base, wherein the bracket housing is removably securable to a vertical surface via a fastener, such as a suction cup. The wig pod can be placed in a shower and attached to a wall of the shower, such that the dome member can receive a wig thereon. Once received on the dome member, the wig can be easily washed while remaining suspended from the wig pod and remain suspended to dry.

21 Claims, 10 Drawing Sheets

(56) References Cited

U.S. PATENT DOCUMENTS

| | | | | | |
|---|---|---|---|---|---|
| 3,740,013 | A * | 6/1973 | Bentley | F16M 11/40 | 223/66 |
| 3,779,433 | A * | 12/1973 | Imai | A45D 44/14 | 223/66 |
| 3,973,676 | A * | 8/1976 | Brooks | A47K 10/12 | 211/88.04 |
| 4,470,527 | A * | 9/1984 | Middleton | F16B 7/10 | 223/66 |
| 6,112,909 | A * | 9/2000 | Moseley | A47G 25/10 | 403/322.2 |
| 6,578,716 | B1 * | 6/2003 | Wei | A47F 7/06 | 223/12 |
| 7,168,577 | B1 * | 1/2007 | Moseley | A47F 7/06 | 211/32 |
| D647,710 | S * | 11/2011 | Anderson | A47F 7/19 | D6/327 |
| 9,226,606 | B1 * | 1/2016 | Nesladek | A47G 25/10 | |
| 9,427,066 | B2 * | 8/2016 | Davidson | A45D 44/14 | |
| 9,538,831 | B1 * | 1/2017 | Tracy | D06F 57/04 | |
| 9,695,974 | B2 * | 7/2017 | Gordon | A45D 44/14 | |
| 10,010,157 | B2 * | 7/2018 | Drain | A47F 7/065 | |
| 10,898,013 | B2 * | 1/2021 | Kempner | A47F 7/02 | |
| 11,259,655 | B1 * | 3/2022 | Humphries | A45D 44/14 | |
| 2007/0039903 | A1 * | 2/2007 | Aiken | A47G 25/10 | 211/30 |
| 2015/0129455 | A1 * | 5/2015 | Williams | A45D 44/00 | 206/526 |
| 2020/0015606 | A1 * | 1/2020 | Ji | A45D 44/14 | |

* cited by examiner

WIG WASHING AND DRYING DEVICE

CROSS REFERENCE TO RELATED APPLICATION

This application claims the benefit of pending U.S. non-provisional application Ser. No. 17/746,026 filed on May 17, 2022, claiming priority to U.S. provisional application No. 63/193,642 filed on May 27, 2021, and U.S. provisional application No. 63/335,264 filed on Apr. 27, 2022. The above identified patent applications are herein incorporated by reference in their entirety.

BACKGROUND OF THE INVENTION

The present invention relates to a wig supporting device. The present invention specifically provides a device for cleaning and drying a wig within a shower or similar location.

It is generally known that many wigs and various other forms of hairpieces are manufactured from human hair or synthetic fibers. It is also common that wearers have many styles or replacement wigs that are used for different occasions. These wigs require periodic conditioning such as washing, drying, and styling.

Wig hair stylists and their clients have always had the problem of conveniently cleaning and drying wigs and transporting and storing styled wigs. Therefore, it is desirable to clean and store wigs when not required for use in a way which preserves their shape and does not take up more space than necessary. It is likewise desirable to be able to transport and store these wigs to varied locations in the same manner. There are a variety of stands in the marketplace for wig storage, but while a stand may be satisfactory to maintain the wig shape, the wig stands are stored in a manner that occupies a large space. For example, one such stand utilizes a mannequin head on a base that sets on a counter. Other wig stands allow only for stationary vertical or linear storage of wigs on a rack that takes up significant floor space, space on clothes racks or wall space and that are screwed into wall studs and are not easy to assemble or disassemble. These manners of storage also cause adjacent wig entanglement providing for no adjustment for wig lengths. These devices are too voluminous and do not display multiple wigs in a pleasing manner. Furthermore, wigs are typically washed by hand in a sink or shower and dried by mechanical means such as with dryers which can alter the wig's appearance or drip dried over obstacles such as hangers that do not maintain the wig's shape. Carrying wet wigs from sinks to showers can also create wet slippery floors.

Additionally, wigs need to be transported and stored with the wearer at varied locations. Usually, transport devices are voluminous such as wig heads, floor or wall stands that may take up voluminous space in luggage and when storing at varied locations can require extensive reassembly. Therefore, there exists a need for a device that takes up little storage space in luggage for transport to varied locations and can be used to suspend a wig for washing, drying, and styling at the varied location in the same manner with ease.

In light of the devices disclosed in the known art, it is submitted that the present invention substantially diverges in design elements and methods from the known art and consequently it is clear that there is a need in the art for an improvement of a wig washing and drying device. In this regard the instant invention substantially fulfills these needs.

SUMMARY OF THE INVENTION

In view of the foregoing disadvantages inherent in the known types of wig washing and drying devices now present in the known art, the present invention provides a wig washing and drying device wherein the same can be utilized for washing, drying, and styling a wig from an interior of a shower and can be transported conveniently to different locations.

It is an objective of the present invention to provide a wig washing and drying device comprising a wig pod mountable to a vertical surface, wherein the wig pod is adapted to receive a wig thereon for maintenance, storage, and styling.

It is another objective of the present invention to provide a wig washing and drying device wherein the wig pod comprises a front facing semi-spherical dome member extending from a base.

It is another objective of the present invention to provide a wig washing and drying device comprising an arm extending between the dome member and the base to prevent contact therebetween.

It is therefore an object of the present invention to provide a new and improved wig washing and drying device that has all of the advantages of the known art and none of the disadvantages.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings.

DETAILED DESCRIPTION OF THE INVENTION

Reference is made herein to the attached drawings. For the purposes of presenting a brief and clear description of the present invention, the preferred embodiment will be discussed as used for cleaning, drying, storing and styling a wig mounted to the wig pods of the wig washing and drying device. The figures are intended for representative purposes only and should not be considered to be limiting in any respect.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment", "first embodiment", "second embodiment", or "third embodiment" does not necessarily refer to the same embodiment.

Figure 1:
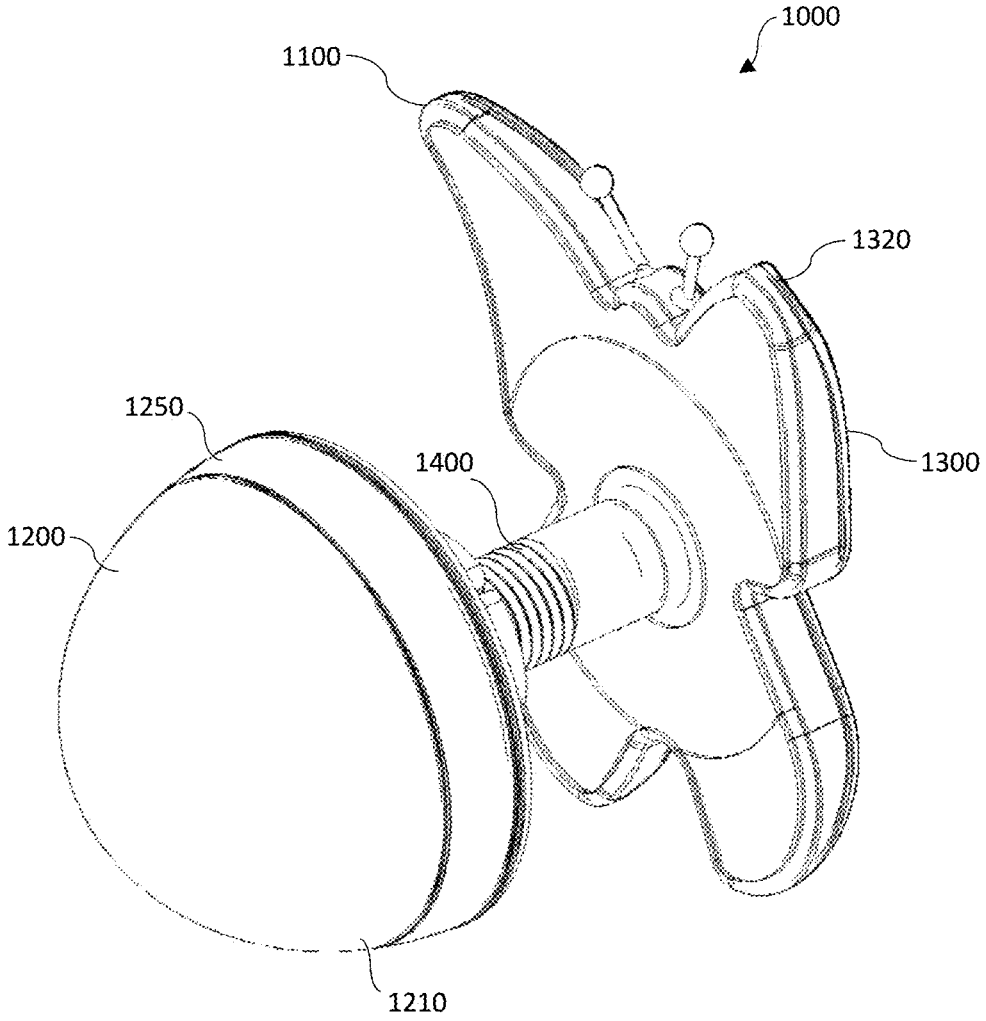
FIG. 1 shows a front perspective view of an embodiment of the wig washing and drying device.
Figure 2:
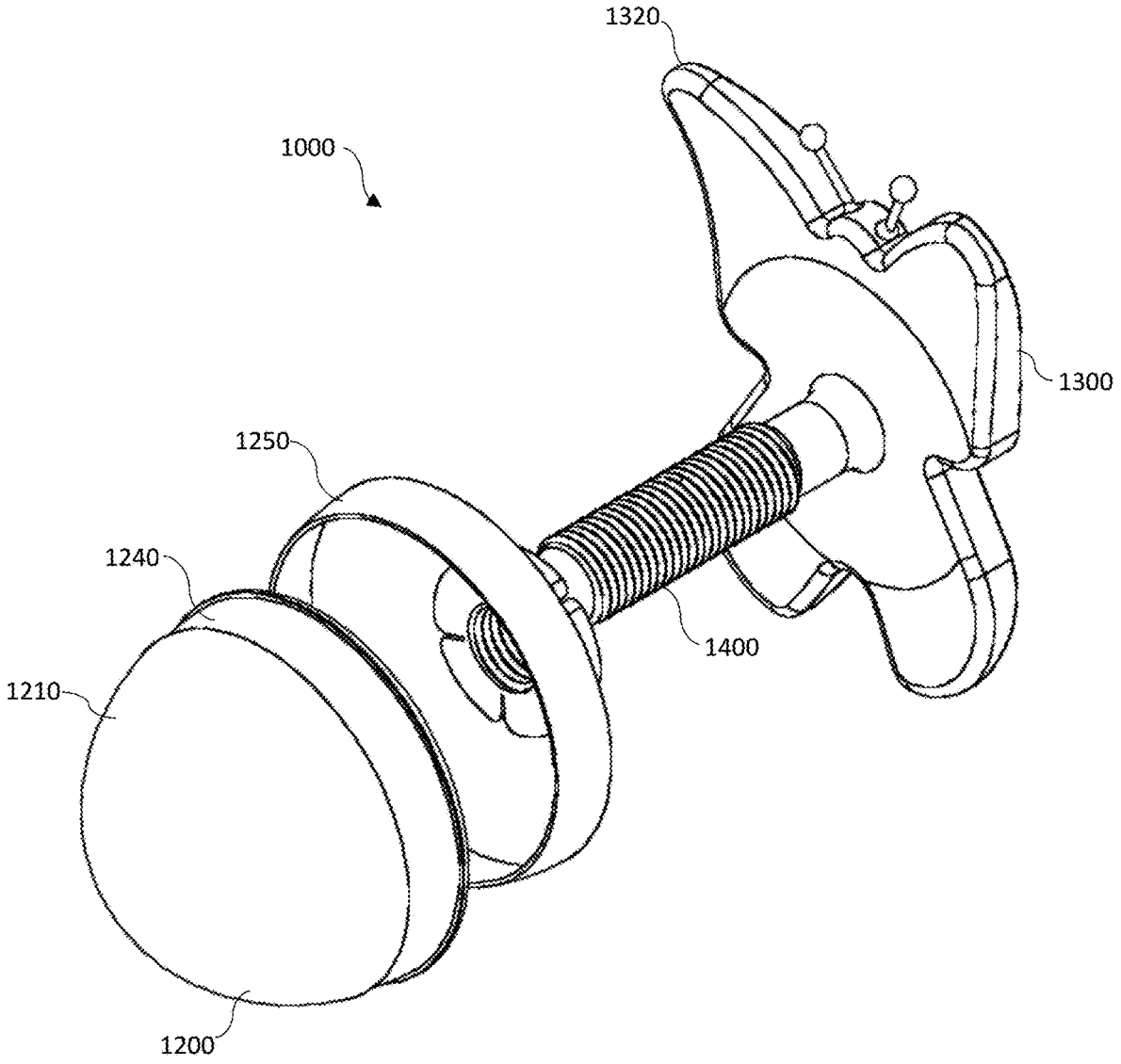
FIG. 2 shows an exploded view of an embodiment of the wig washing and drying device.
Figure 3:
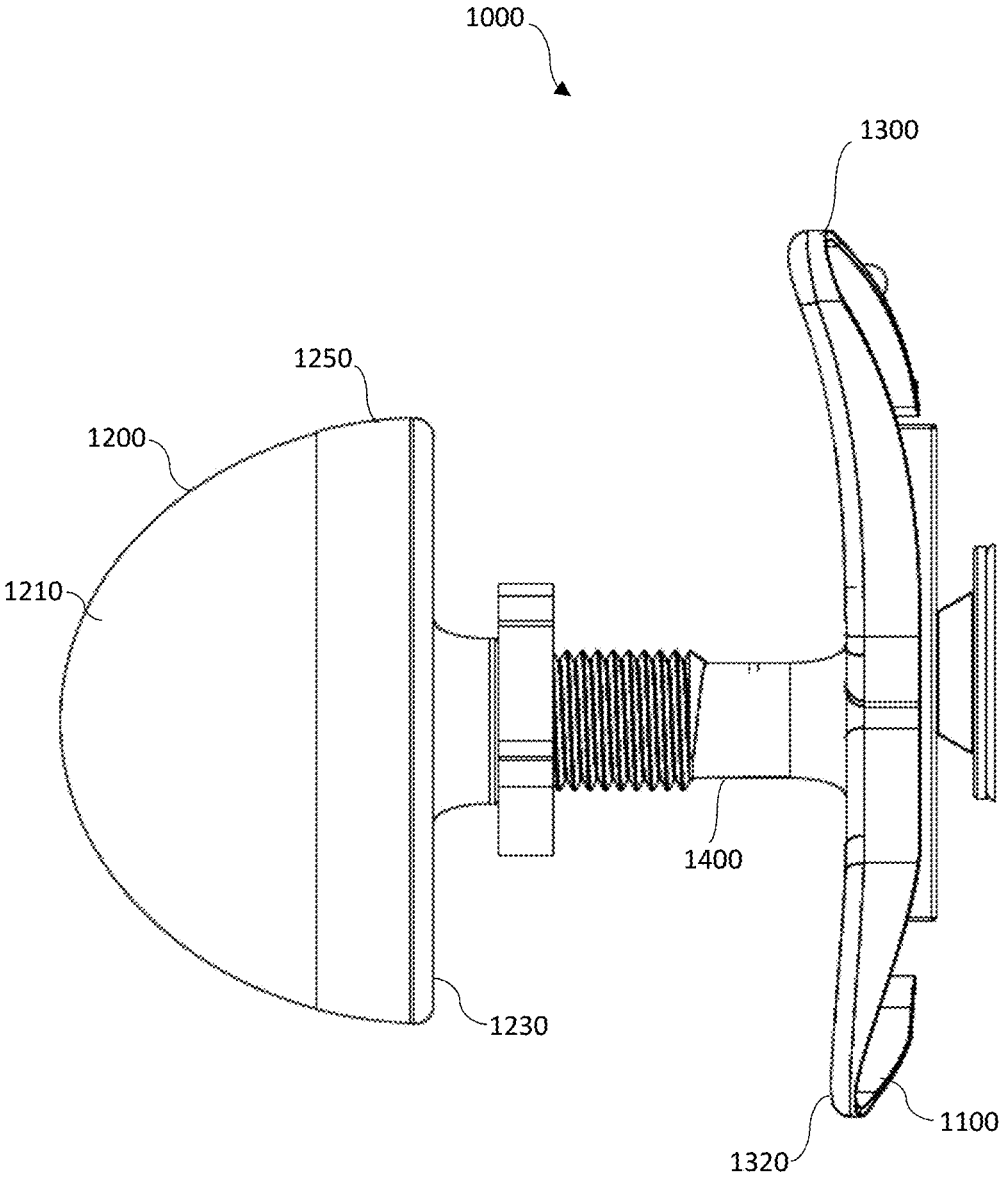
FIG. 3 shows a side view of an embodiment of the wig washing and drying device.

Referring now to FIGS. 1-3, there is shown a front perspective view, an exploded view, and a side view of an embodiment of the wig washing and drying device, respectively. The wig washing and drying device 1000 comprises a wig pod 1100 having a front facing dome member 1200 extending from a base 1300. The structure of the dome member 1200 mimics a general round shape of a head to allow the integrity and shape of the wig to be maintained while not being worn. The dome member 1200 includes a generally curved front facing portion 1210 and an opposing flat side 1230 that is rear facing. In the illustrated embodiment, the dome member 1200 comprises a substantially similar size to the base 1300. An arm 1400 extends from the flat rear side 1230 and connects with the base 1300 at a central region. In some embodiments, the dome member comprises a fastener configured to removably secure the wig thereto.

In the illustrated embodiment, the wig washing and drying device comprises a ring-shaped indent 1240 disposed around the front facing portion of the dome member 1200, wherein the ring-shaped indent 1240 is configured to receive a ring member 1250 therein. In some embodiments, a portion of the wig is adapted to be positioned within the indent 1240 and the indent is configured to receive the ring member 1250 to secure the wig to the dome member 1200. In this way, the stability of the wig by securing it in place within the device is enhanced. In the illustrated embodiment, the indent circumscribes the dome member 1200.

Figure 4:
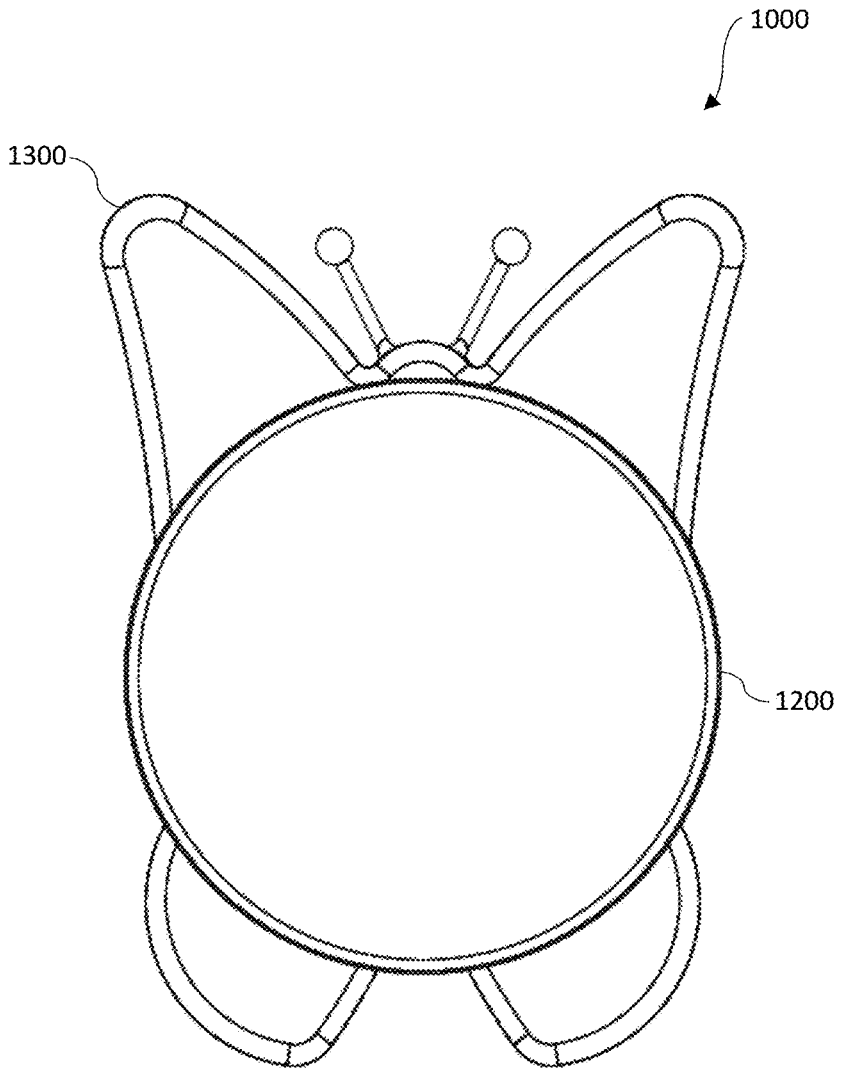
FIG. 4 shows a front view of an embodiment of the wig washing and drying device.

In the illustrated embodiment, the dome member 1200 comprises a circular cross section having a larger width compared to the base 1300, providing a broader area for the wig to rest upon. Conversely, in the illustrated embodiment, the base 1300 comprises a larger length than the dome member 1200, contributing to the overall stability and balance of the device when the base is secured to a wall (as seen in FIG. 4). However, in alternate embodiments, the base comprises a larger width and the dome member comprises a larger length. In other embodiments, the base and the dome member comprise a same width and length to one another.

The base 1300 is adapted to secure to a vertical surface such as a wall of a shower. The device is configured to allow a wig to suspend therefrom while in the shower to allow the wig to be easily washed and dried in the shower. In the illustrated embodiment, the base 1300 comprises a butterfly shape. However, in alternate embodiments, the base comprises any suitable shape. The butterfly shape provides raised corners 1320 that allow a user to easily slide his or her fingers behind the base 1300 to grasp and remove the wig pod 1100 from the vertical surface.

Figure 5:
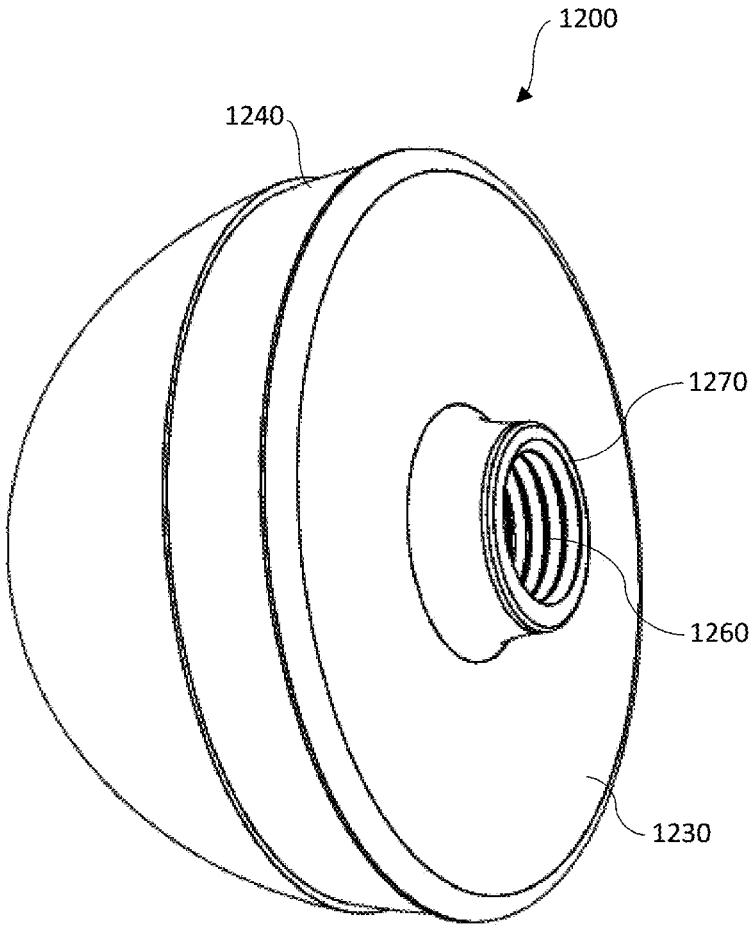
FIG. 5 shows a rear view of a dome member of the wig washing and drying device.
Figure 6:
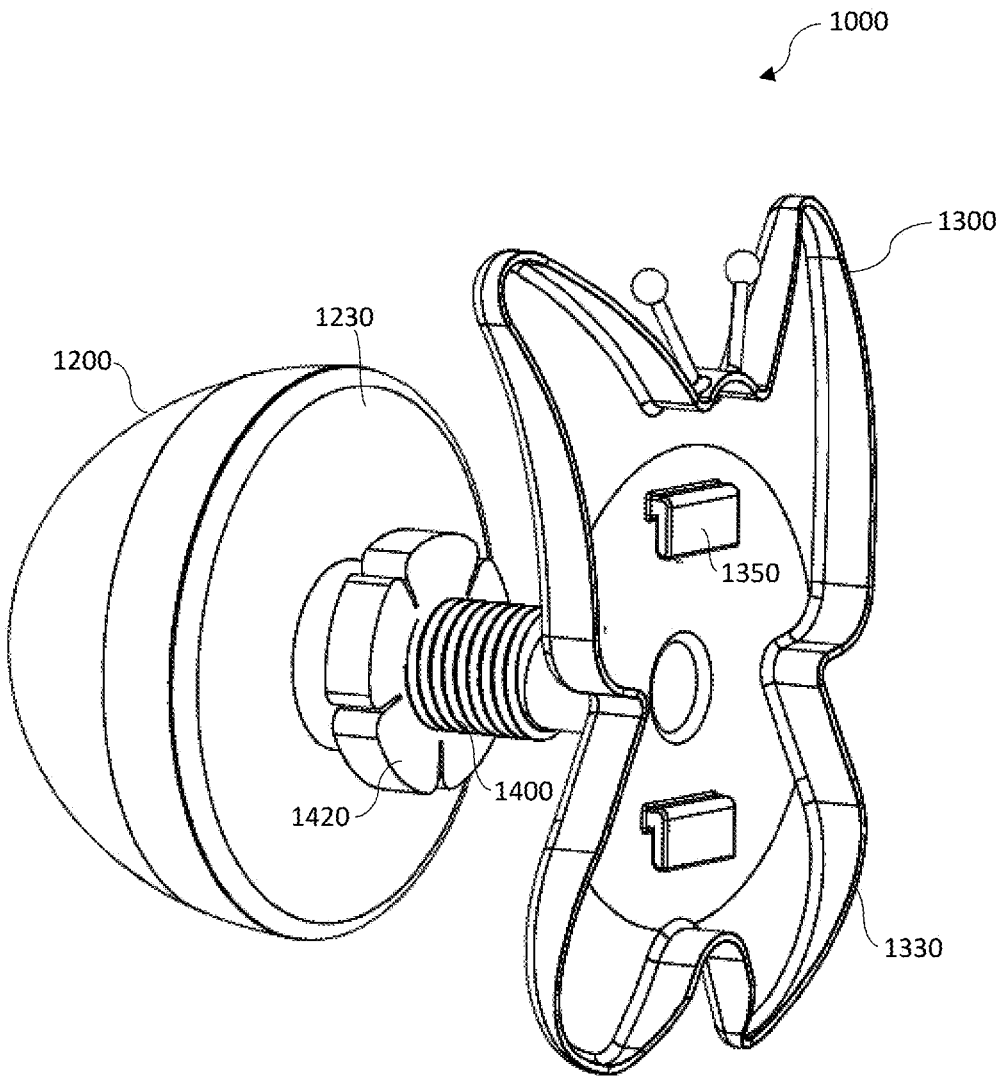
FIG. 6 shows a rear perspective view of an embodiment of the wig washing and drying device.

Referring now to FIGS. 5 and 6, there is shown a rear view of a dome member of the wig washing and drying device and a rear perspective view of an embodiment of the wig washing and drying device, respectively. To prevent contact between the dome member 1200 and the base 1300, in the illustrated embodiment, the arm 1400 extends from the flat rear facing side 1230 of the dome member 1200 and keeps them separated. The arm 1400 is linear between the opposing ends and allows for efficient airflow during the drying process to prevents potential damage to the wig's fibers.

In the illustrated embodiment, the dome member 1200 comprises a recess 1260 is disposed on a central area of the rear side 1230 thereof for receiving the first end of the arm 1400. A rim 1270 extends around the recess configured to serve as a guide to the arm 1400 when being inserted within the recess. The rim 1270 further enhances the stability of the connection between the dome member and the arm. In the illustrated embodiment, the dome member 1200 is removably secured to the arm 1400 via a fastener, such as a threaded connection. In the illustrated embodiment, the interior wall of the recess comprises a thread and the arm 1400 comprises an exterior thread to allow a user to adjust the distance between the dome member 1200 and the base 1300. This is beneficial to allow the user to suspend a wet wig above a container or bathtub that is not directly against the wall or wherein a container or tub can vary in distance from a wall. In the illustrated, the dome member 1200 is further secured via a nut 1420 extending around the arm 1400 such that the nut prevents the dome member 1200 from moving along the arm 1400.

Figure 7:
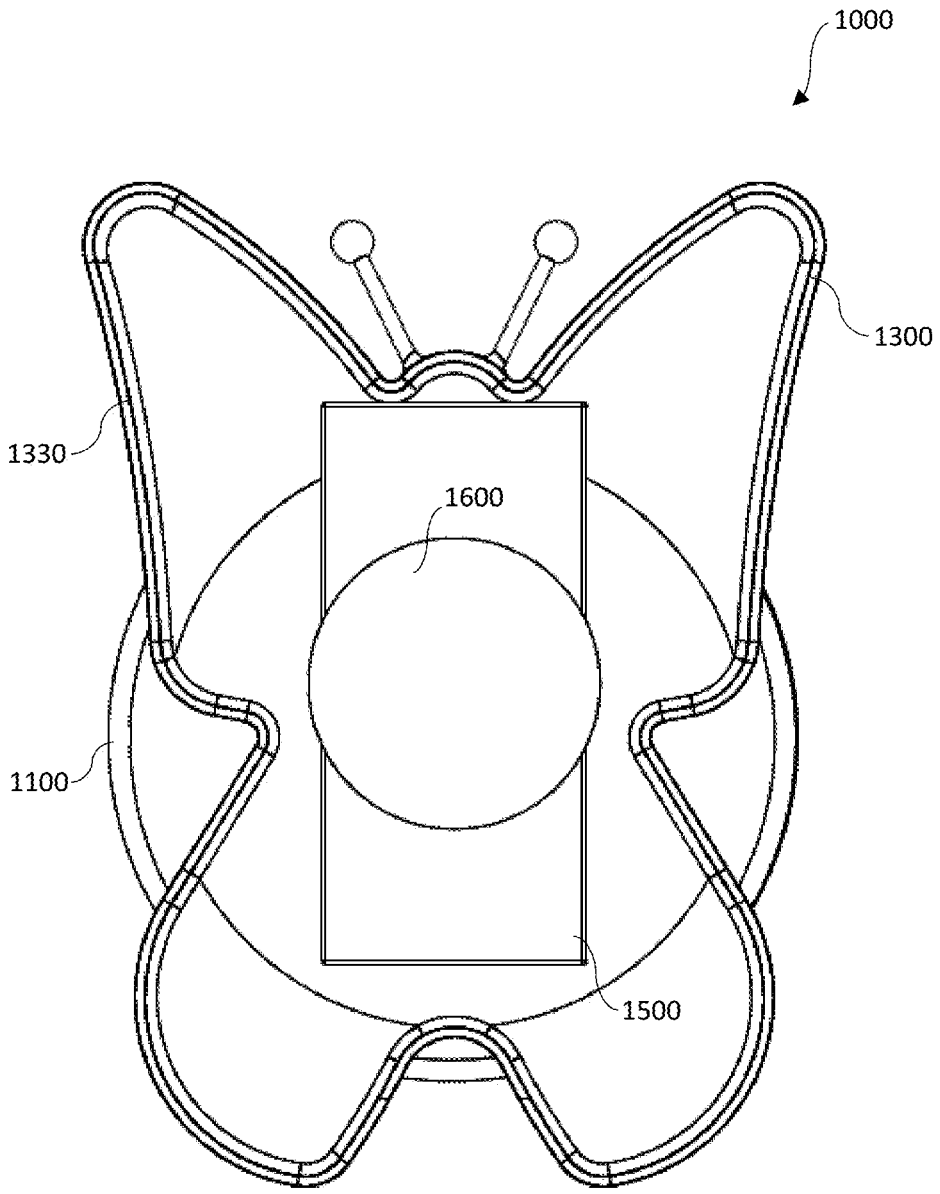
FIG. 7 shows a rear view of an embodiment of the wig washing and drying device.
Figure 8:
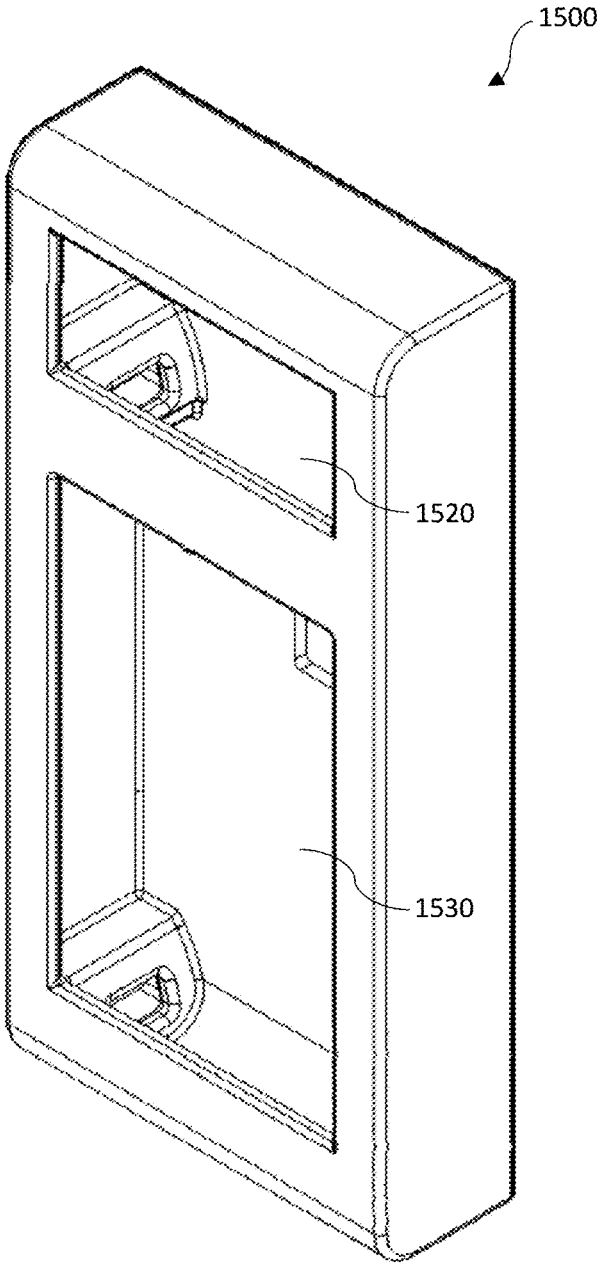
FIG. 8 shows a perspective view of a bracket housing of the wig washing and drying device.
Figure 9:
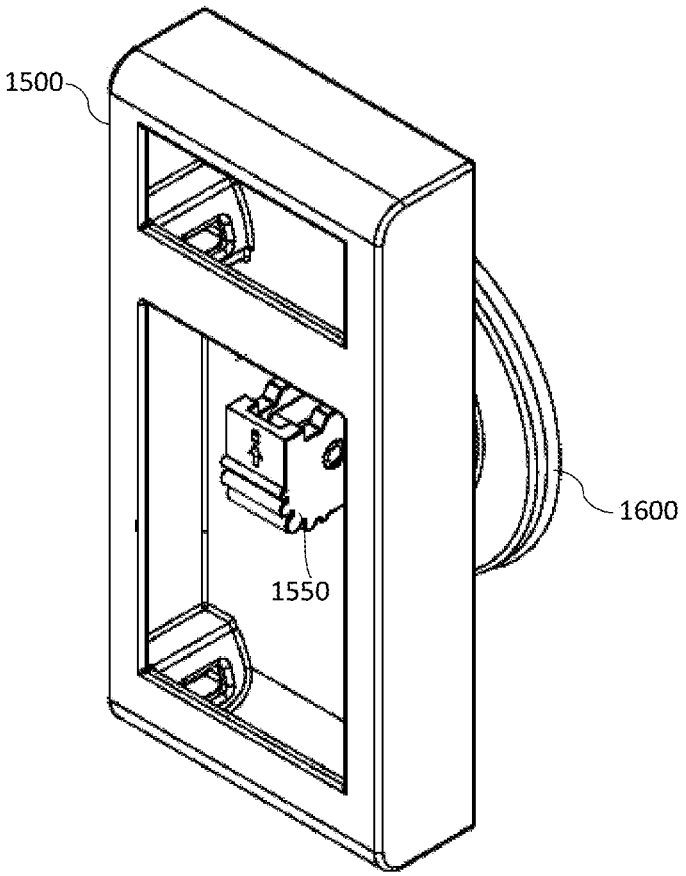
FIG. 9 shows a perspective view of a bracket housing and fastener of the wig washing and drying device.

Referring now to FIGS. 7-9, there is shown a rear view of an embodiment of the wig washing and drying device, a perspective view of a bracket housing of the wig washing and drying device, and a perspective view of a bracket housing and fastener of the wig washing and drying device, respectively. In the illustrated embodiment, the base 1300 includes a lip 1330 extending toward the rear side and around an entire perimeter thereof. The lip 1330 serves to form a housing on the rear side of the base 1300 for receiving a bracket member 1500 configured to secure the wig pod 1100 to the wall. By seating the bracket housing within the base, the overall structural integrity of the device is enhanced. Additionally, the hollow, recessed base 1300 of the wig pod 1100 serves to conceal the bracket housing 1500 when secured to a shower wall.

The rear side of the base 1300 comprises a fastener for securing the bracket member 1500 thereto. In the illustrated embodiment, the fastener is a pair of L-shaped protrusions 1350 (seen in FIG. 6) that are vertically stacked around the position of arm 1400. The L-shaped protrusions 1350 are configured to insert within an upper opening 1520 and a lower opening 1530 of the bracket housing 1500. The upper and lower openings are disposed on the front side of the bracket member and are dimensioned to receive a respective L-shaped fastener through the opening. Once the L-shaped fastener is positioned within the bracket housing 1500, the wig pod 1100 is lowered relative to the bracket housing 1500 to allow the L-shaped fasteners to latch onto the bracket housing 1500. In the shown embodiment, the lower opening is larger than the upper opening to facilitate the separation of the base from the bracket housing. The configuration of the fasteners allow the wig pod 1100 to easily snap on and off of the bracket housing 1500. In this way, a single wig pod can be positioned on different bracket housings each having a different type of fastener or positioned in a different location. For example, a first bracket housing can be secured to a shower wall via a suction cup, wherein a second bracket housing can be suspended from a door with a hook or similar fastener. In this way, a user can easily clean a wig in the shower and transfer the wig pod to a second bracket in a room or closet for storage or styling.

In the illustrated embodiment, the bracket housing 1500 comprises a suction cup fastener 1600 configured to secure to the wall when wet, such as during the cleaning of the wig. The suction cup fastener extends from a rear side of the bracket housing 1500, wherein the fastener 1600 is disposed above the arm in an assembled configuration. In the shown embodiment, a lock 1550 is disposed within the bracket housing 1500 configured to secure the fastener to the bracket housing.

Figure 10:
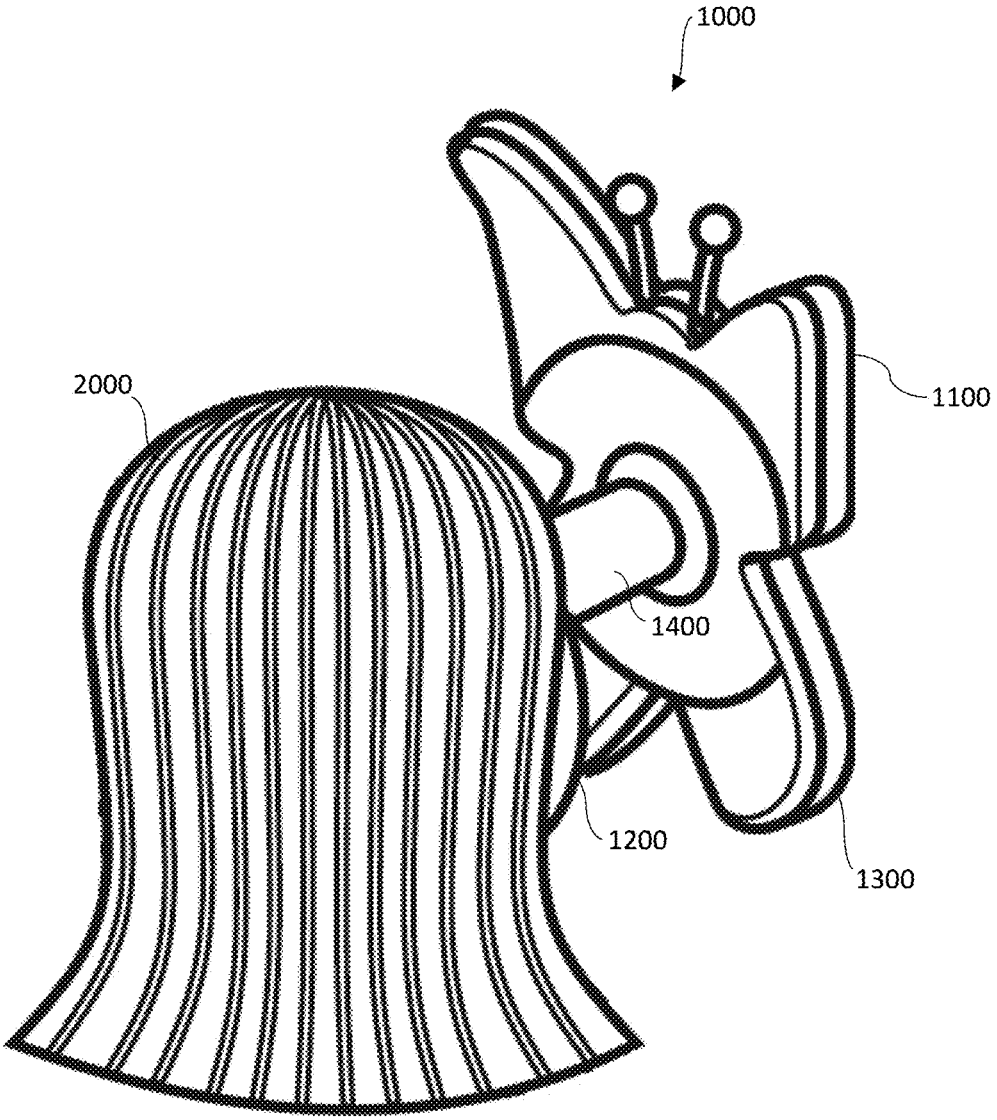
FIG. 10 shows a perspective view of an embodiment of the wig washing and drying device in use.

Referring now to FIG. 10, there is shown a perspective view of an embodiment of the wig washing and drying device in use. In operation, the wig pod 1100 is assembled such that the arm 1400 connects the dome member 1200 to the base 1300 thereof. The bracket housing is secured to the rear side of the base, wherein a fastener on the bracket housing removably secures the wig pod and base to a vertical surface, such as the shower. When assembled, a wig 2000 is secured to the front facing portion of the dome member and secured thereto via the ring member. Once secured, the user is able to freely wash, dry and style the wig in a single location. When complete, the wig device 1000 is configured to be easily and manually disassembled without the need for any hand tools such as screw drivers or wrenches, wherein the device 1000 can be conveniently stored or packed in a standard size suitcase for travel.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wig washing and drying device, comprising:

a wig pod having a front facing dome member extending from a base;

wherein the dome member comprises a generally curved front facing portion and an opposing flat side that is rear facing, wherein an arm extends from the flat side and connects with the base at a central region of the base;

a ring-shaped indent disposed around the front side the dome member, wherein the ring-shaped indent is configured to receive a ring member therein;

a bracket housing extending from a rear side of the base, wherein the bracket housing is configured to be removably securable to a vertical surface via a fastener.

2. The wig washing and drying device of claim 1, wherein the dome member comprises a recess in a central area of the rear side thereof for receiving the arm.

3. The wig washing and drying device of claim 1, wherein the front facing portion is adapted to receive a wig thereon such that the front facing portion mimics a shape of a head.

4. The wig washing and drying device of claim 1, wherein the dome member comprises a larger width than the base.

5. The wig washing and drying device of claim 1, wherein the base comprises a larger length than the dome member.

6. The wig washing and drying device of claim 1, wherein the arm prevents the dome member from contacting the base.

7. The wig washing and drying device of claim 1, wherein the base comprises a lip extending toward the rear side and around an entire perimeter thereof.

8. The wig washing and drying device of claim 1, wherein the rear side of the base comprises a pair of L-shaped protrusions configured to removably secure the bracket housing thereto, such that the bracket housing is seated within the base.

9. The wig washing and drying device of claim 1, wherein the fastener of the bracket housing extends from a rear side thereof.

10. The wig washing and drying device of claim 1, wherein the bracket housing comprises a front side having an upper opening and a lower opening, wherein each opening is configured to receive a fastener extending from the rear side of the base.

11. The wig washing and drying device of claim 10, wherein the fastener comprises a first L-shaped protrusion configured to extend within the upper opening and a second L-shaped protrusion configured to extend within the lower opening.

12. The wig washing and drying device of claim 1, wherein a corner of the base curves toward the front side of the wig pod to serve as a finger hold for a user when detaching the wig pod from the vertical surface.

13. The wig washing and drying device of claim 1, wherein the rear side of the dome member comprises a rim disposed around a recess configured to receive the arm into the dome member.

14. The wig washing and drying device of claim 1, wherein the dome member is removably secured to the arm.

15. The wig washing and drying device of claim 1, wherein the dome member is removably secured to the arm via a threaded connection and secured via a nut extending around the arm such that the nut prevents the dome member from moving along the arm.

16. The wig washing and drying device of claim 1, wherein the fastener is a suction cup.

17. The wig washing and drying device of claim 1, further comprising a lock disposed within the bracket housing configured to secure the fastener to the bracket housing.

18. The wig washing and drying device of claim 1, wherein the bracket housing fits within the rear side of the base.

19. A wig washing and drying device, comprising:

a wig pod having a front facing dome member extending from a base;

wherein the dome member comprises a generally curved front facing portion and an opposing flat side that is rear facing, wherein an arm extends from the flat side and connects with the base at a central region of the base;

a bracket housing extending from a rear side of the base, wherein the bracket housing is configured to be removably securable to a vertical surface via a fastener;

wherein the rear side of the base comprises a pair of L-shaped protrusions configured to removably secure the bracket housing thereto, such that the bracket housing is seated within the base.

20. A wig washing and drying device, comprising:

a wig pod having a front facing dome member extending from a base;

wherein the dome member comprises a generally curved front facing portion and an opposing flat side that is rear facing, wherein an arm extends from the flat side and connects with the base at a central region of the base;

wherein the dome member is removably secured to the arm via a threaded connection and secured via a nut extending around the arm such that the nut prevents the dome member from moving along the arm;

a bracket housing extending from a rear side of the base, wherein the bracket housing is configured to be removably securable to a vertical surface via a fastener.

21. A wig washing and drying device, comprising:

a wig pod having a front facing dome member extending from a base;

wherein the dome member comprises a generally curved front facing portion and an opposing flat side that is rear facing, wherein an arm extends from the flat side and connects with the base at a central region of the base;

a bracket housing extending from a rear side of the base, wherein the bracket housing is configured to be removably securable to a vertical surface via a fastener;

wherein the bracket housing comprises a front side having an upper opening and a lower opening, wherein each opening is configured to receive a fastener extending from the rear side of the base;

wherein the fastener comprises a first L-shaped protrusion configured to extend within the upper opening a second L-shaped protrusion configured to extend within the lower opening.

* * * * *